US008118119B2

(12) United States Patent
Dourfaye et al.

(10) Patent No.: US 8,118,119 B2
(45) Date of Patent: Feb. 21, 2012

(54) IMPREGNATED ROTARY BIT

(75) Inventors: Alfazazi Dourfaye, Paris (FR); Michel De Reynal, Arthez de Bearn (FR)

(73) Assignee: Varel International Ind., L.P., Carrollton, TX (US)

( * ) Notice: Subject to any disclaimer, the term of this patent is extended or adjusted under 35 U.S.C. 154(b) by 446 days.

(21) Appl. No.: 12/326,757

(22) Filed: Dec. 2, 2008

(65) Prior Publication Data

US 2009/0145668 A1 Jun. 11, 2009

Related U.S. Application Data

(60) Provisional application No. 61/012,094, filed on Dec. 7, 2007.

(51) Int. Cl.
*E21B 10/43* (2006.01)
*E21B 10/46* (2006.01)

(52) U.S. Cl. ..... 175/420.2; 175/412; 175/413; 175/426; 175/434

(58) Field of Classification Search ..... 175/401, 175/412, 413, 415, 419, 420.2, 426, 434, 175/394, 396
See application file for complete search history.

(56) References Cited

U.S. PATENT DOCUMENTS

| | | | | |
|---|---|---|---|---|
| 4,445,580 | A * | 5/1984 | Sahley | 175/404 |
| 6,095,265 | A | 8/2000 | Alsup | |
| 6,510,906 | B1 | 1/2003 | Richert et al. | |
| 6,742,611 | B1 | 6/2004 | Illerhaus et al. | |
| 6,843,333 | B2 | 1/2005 | Richert et al. | |
| 2002/0066601 | A1 * | 6/2002 | Meiners et al. | 175/431 |
| 2006/0162967 | A1 * | 7/2006 | Brackin et al. | 175/374 |
| 2009/0217597 | A1 | 9/2009 | Brackin et al. | |

* cited by examiner

*Primary Examiner* — Brad Harcourt

(74) *Attorney, Agent, or Firm* — Gardere Wynne Sewell LLP; Andre M. Szuwalski

(57) ABSTRACT

A drill bit includes a plurality of continuous segments impregnated with diamond that are each mounted to form a corresponding blade. The regions between the blades define a plurality of fluid passages on the bit face. The blades extend radially outwardly to the gage. The continuous segments may be either straight or spiral in design. Furthermore, the design of the segments supports varying one or more of: diamond content, width, back rake angle and/or relief angle along a length of the segment.

22 Claims, 11 Drawing Sheets

IMPREGNATED ROTARY BIT

PRIORITY CLAIM

The present application claims the benefit of U.S. Provisional Application Patent No. 61/012,094 filed Dec. 7, 2007 entitled "Impregnated Rotary Bit", the disclosure of which is hereby incorporated by reference to the maximum extent allowable by law.

BACKGROUND OF THE INVENTION

1. Technical Field of the Invention

The present invention relates generally to earth boring bits, and more particularly to a rotary drag bit mounted with a straight or spiral bladed segment impregnated with diamond for drilling a variety of types of rock.

2. Description of Related Art

Impregnated drill bits typically employ a cutting face composed of superabrasive cutting particles, such as natural or synthetic diamond grit, dispersed within a matrix of wear-resistant material. As such a drill bit is operated to drill a formation, the matrix and embedded diamond particles wear, worn cutting particles are lost and new cutting particles are exposed. These diamond particles may either be natural or synthetic and may be cast integral with the body of the bit, as in low-pressure infiltration, or may be preformed separately, as in hot isostatic pressure infiltration, and attached to the bit by brazing or furnaced to the bit body during the manufacturing by an infiltration process.

Reference is now made to FIG. 1 which shows a prior art impregnated bit. This bit is made with aggregate of diamond and matrix powder which is infiltrated. The diamond particles are cast within a supporting material to form an abrasive layer. During operation of the drill bit, diamonds within the abrasive layer are gradually exposed as the supporting material is worn away. A limitation of this bit concerns the impossibility to customize the wear rate because of the homogeneous distribution of the diamond within the abrasive layer. Reference is made to U.S. Pat. No. 6,095,265, the disclosure of which is hereby incorporated by reference, which provides a solution to this issue.

In the late 1990's, new designs were introduced which were based on the use of discrete segment impregnated cutting structures extending upwardly from abrasive particulate-impregnated blades defining a plurality of fluid passages between on the bit face. FIG. 2 shows an example of a prior art use of bladed segments mounted on straight blade cutting structures.

FIG. 3 shows an example of a prior art use of discrete segments mounted on a spiral cutting structure.

Reference is further made to: "Impregnated Rotary Drag Bit", U.S. Pat. No. 6,843,333; "Laminated and Composite Impregnated Cutting Structures for Drill Bits", U.S. Pat. No. 6,742,611; and "Impregnated Bit with PDC Cutters in Cone Area", U.S. Pat. No. 6,510,906, the disclosures of all of which being incorporated by reference herein.

SUMMARY OF THE INVENTION

The present invention is related to a drill bit using a plurality of continuous and spiraled/straight segments impregnated with diamond that are mounted to form spiraled/straight blades defining a plurality of fluid passages on the bit face. The spiraled/straight blades may extend radially outwardly to the gage.

The segments can be either mounted on a matrix body or steel body bit.

The segments are attached to the bit body by brazing or furnaced.

The spiraled segments cover the borehole in 360°.

The drill bit supports the use of interchangeable nozzles.

The top blade shape supports design adjustments to suit the drillability of the rock to be penetrated. Both positive and negative back rake angles for the blade shape are supported in the design of the bit. A relief angle in the top surface of the segment may also be provided in the design of the bit if desired. The value of the negative relief angles provided by the design gradually changes in the design from the inner to the outer part of the bit. This may fit the ratio: Depth of cut/Circumference at any point radial point.

In addition, the design may provide, with respect to each of the width, back rake angle and the relief angle of the impregnated segment, for a selected continuous change over the length of the continuous segment.

The diamond content of each segment may also change along the length of each segment.

BRIEF DESCRIPTION OF THE DRAWINGS

Other features and advantages of the invention will become clear in the description which follows of several non-limiting examples, with reference to the attached drawings wherein.

DETAILED DESCRIPTION OF THE DRAWINGS

In accordance with an embodiment of the invention, a drill bit includes a plurality of continuous spiral segments impregnated with diamond that are mounted to form spiraled blades. The regions between the spiraled blades define a plurality of fluid passages on the bit face. The spiraled blades may extend radially outwardly to the gage to provide increased blade length and enhanced cutting structure redundancy and diamond content.

Alternatively, an embodiment of a drill bit includes a plurality of continuous straight segments impregnated with diamond that are mounted to form straight blades. The regions between straight blades define a plurality of fluid passages on the bit face. The straight blades may extend radially outwardly to the gage.

Each segment for a blade can be mounted on either a matrix body or steel body bit, and are preferably attached to the bit body by brazing or furnacing.

In comparison to the prior art, the bit embodiments of the present invention which are disclosed herein use blade segments. More specifically, continuous spiral or straight blade segments are used wherein the design of those blade segments can be customized (for example, as to shape, diamond content, diamond grain size, diamond type, matrix properties) in the radial direction, in the angular direction and through the segment thickness.

Figure 1:
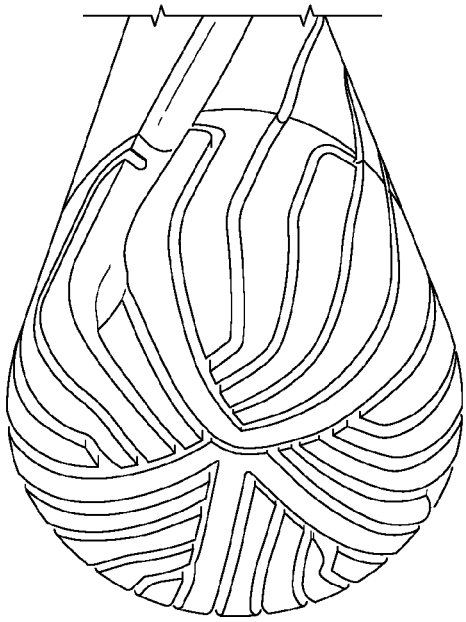
FIG. 1 (PRIOR ART)
FIG. 1 shows a prior art impregnated bit.
Figure 2:
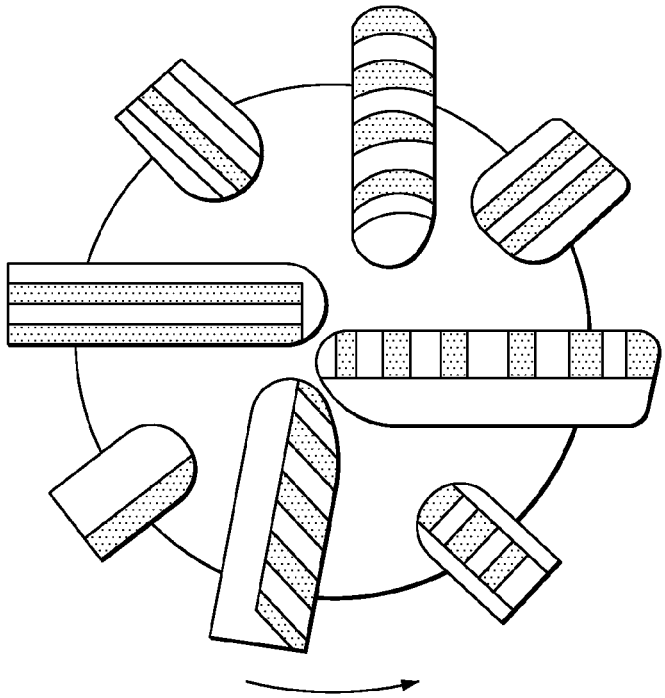
FIG. 2 (PRIOR ART)
FIG. 2 shows an example of prior art bladed segments mounted on straight blade cutting structures.
Figure 3:
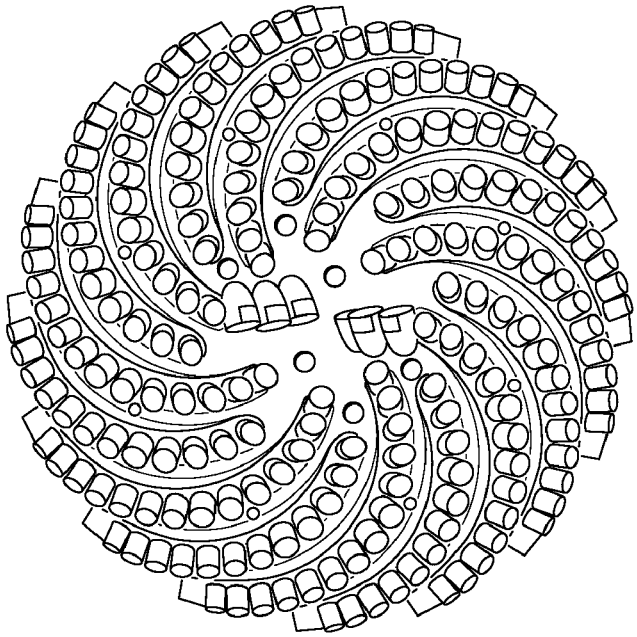
FIG. 3 (PRIOR ART)
FIG. 3 shows an example of a prior art use of discrete segments mounted on a spiral cutting structure.
Figure 4A:
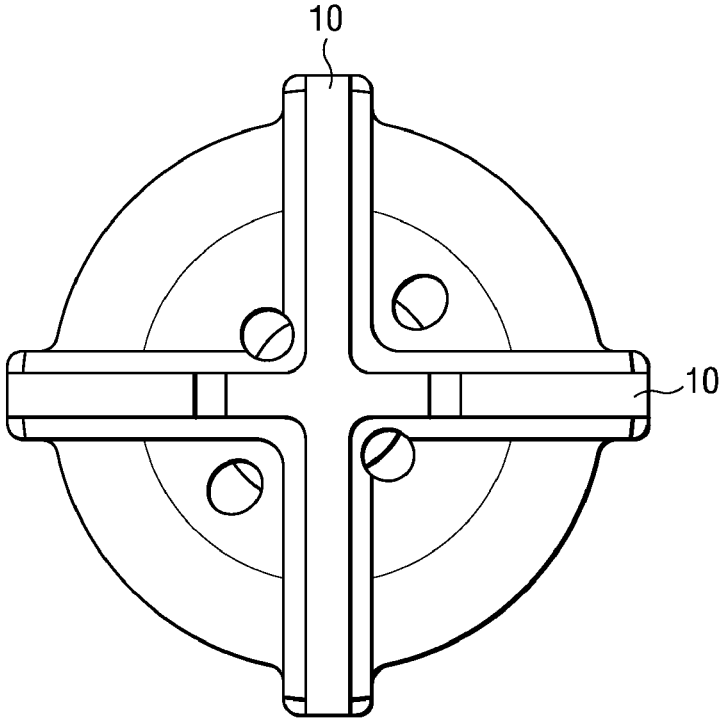
FIGS. 4A and 4B illustrate the presence of continuous segments used in a standalone manner in a straight blade cutting structure.
Figure 4B:
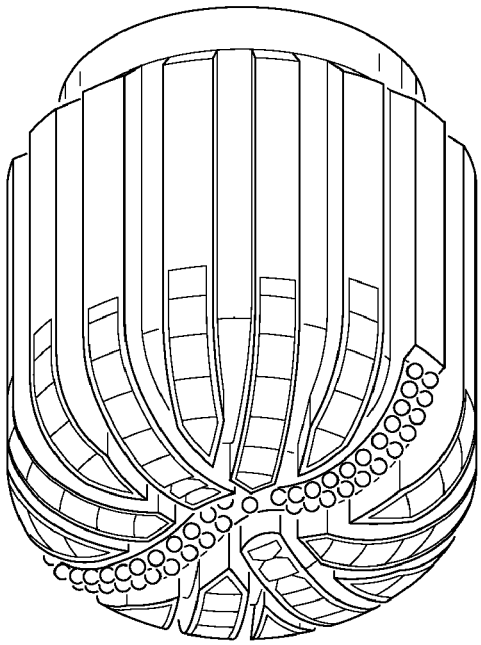

Reference is now made to FIGS. 4A and 4B which illustrate the presence of continuous segments 10 used in a standalone manner in a straight blade cutting structure. These segments 10 are blade segments since they extend for the length of, and assist in defining the configuration of, the blades for the bit.

Figure 4C:
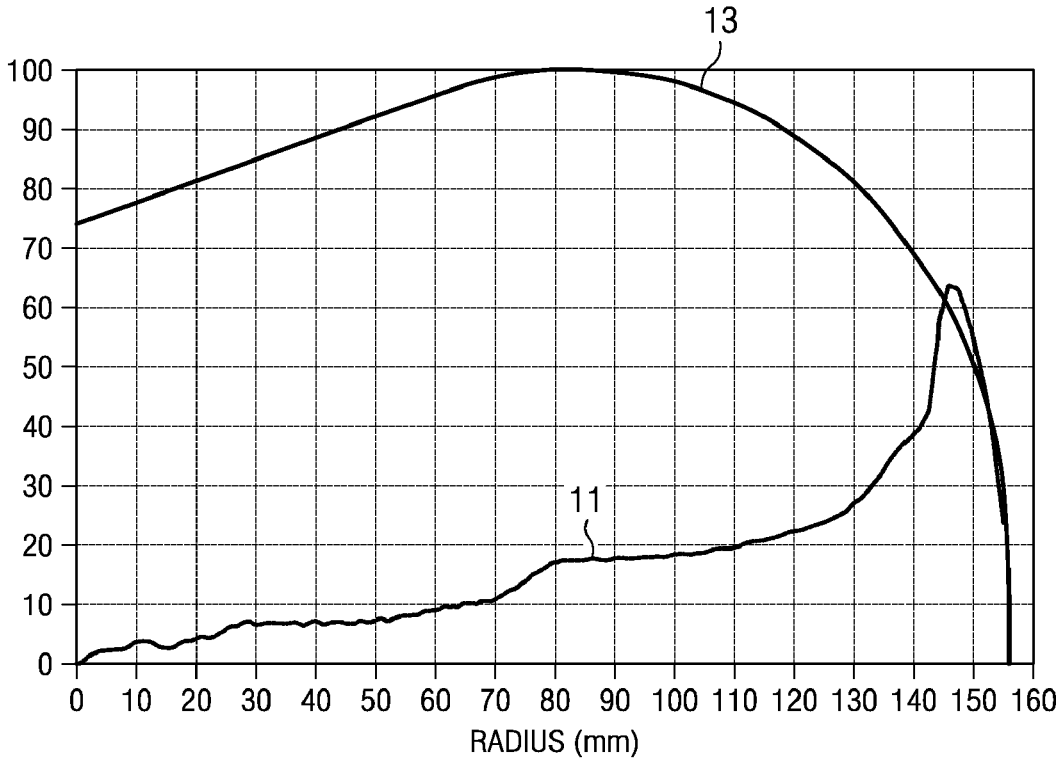
FIG. 4C graphically illustrates diamond content as a function of radius for the segments of FIGS. 4A and 4B.

With respect to the bit designs of FIGS. 4A and 4B, the use of a straight continuous segment 10 provides the ability of better borehole coverage and a better control of the diamond distribution along the radial direction. No discrepancy exists in the diamond content in the radial direction. It is possible to define a function such as diamond content [carat]=f(radius) in the design of the segment. The function can be constant, decrease from low value (at the inner part of the bit) to high value (at the outer part of the bit) or have a peak value located between the bit nose and the bit shoulder depending on the application. This is graphically illustrated in FIG. 4C for exemplary configurations (where carats are measured on the left-most one of the two illustrated y-axes with line 11, diamond content on the right-most one of the two illustrated y-axes with line 13 and radius is measured on the x-axis).

Figure 4D:
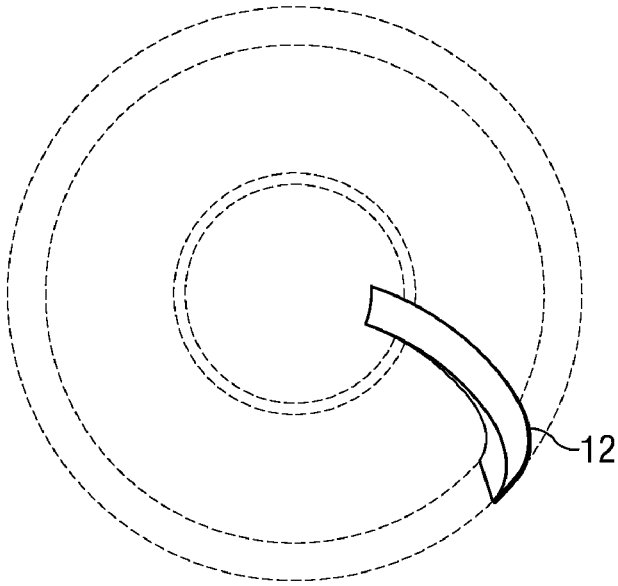
FIGS. 4D and 4E illustrate the presence of continuous segments used in a standalone manner in a spiraled blade cutting structure.
Figure 4E:
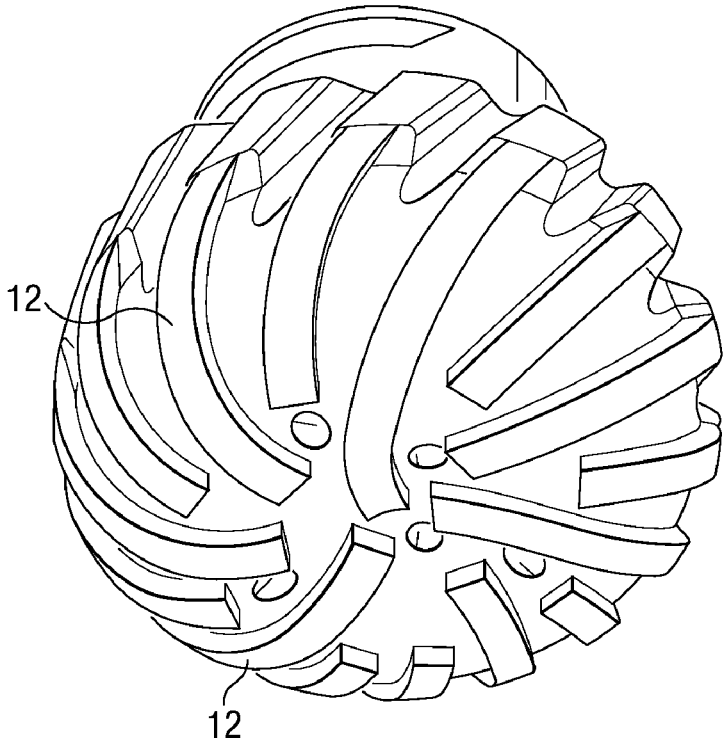

Reference is now made to FIGS. 4D and 4E which illustrate the presence of continuous segments 12 used in a standalone manner in a spiral blade cutting structure. Again, these segments 12 are blade segments since they extend for the length of, and assist in defining the configuration of, the blades for the bit. These segments may also, if desired have a diamond content as a function of radius (see, FIG. 4C) like that described above for the segments 10.

Figure 4F:
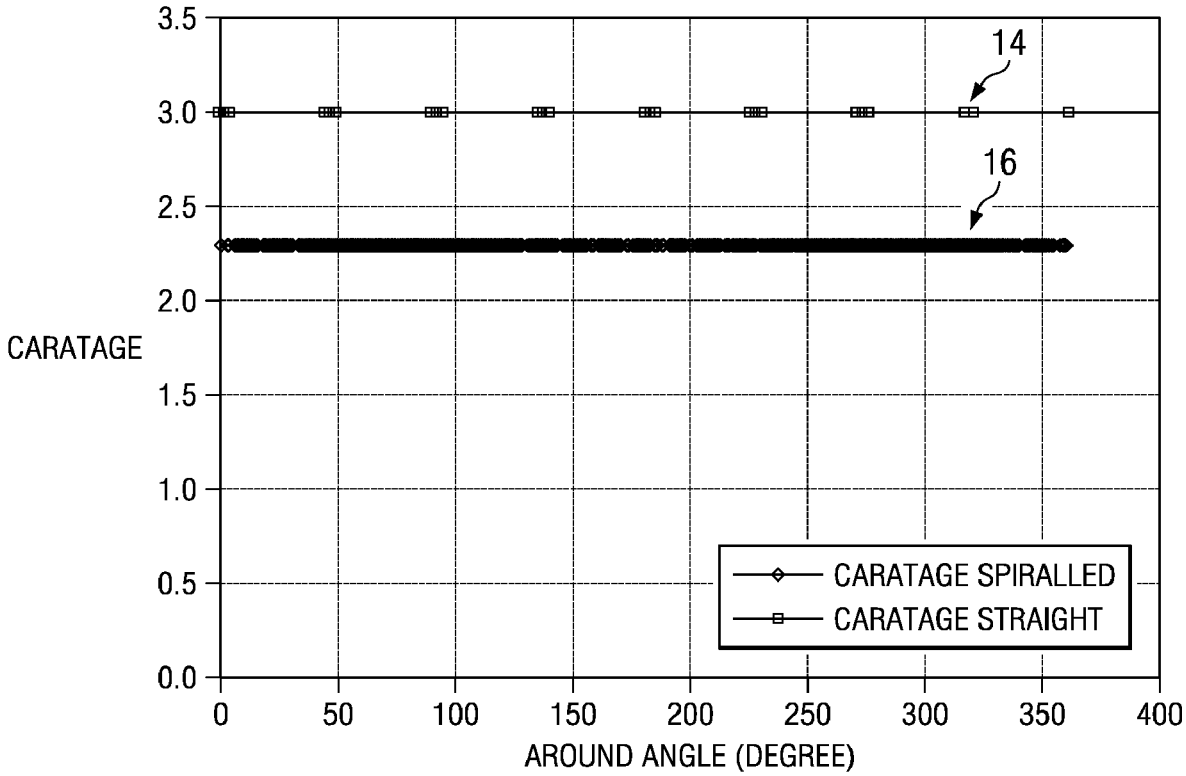
FIG. 4F graphically shows the difference in the carat distribution between an eight straight bladed bit and a spiral bladed bit.

The spiraled segments 12 illustrated in FIGS. 4D and 4E have an advantage over the straight segments 10 shown for example in FIG. 4A in that they additionally guarantee better hole coverage in the angular direction. FIG. 4F graphically shows the difference in the carat distribution between a bit with eight straight blades bit (distribution 14) and a bit with a number of spiral blades (distribution 16) as a function of angular position. The y-axis measures caratage, and the x-axis measures angular degree about the bit. A bit with straight segments (distribution 14 with the dashed line) shows discontinuous angular coverage, while a bit with spiraled segments (distribution 16 with the continuous line) provides for continuous coverage over angle.

Thus, an advantage of using a spiraled segment 12 is to cover the borehole in 360° which provides for a smoother fluctuation of the bit loading and increases the diamond content on the bit.

The selection between the design of straight segment and spiral segment bladed bits is driven by the dynamic and the vibration of the bit in addition to the carat distribution. FIG. 4F clearly shows that there is more diamond on the spiraled segment bit (with its continuous coverage).

Figure 5:
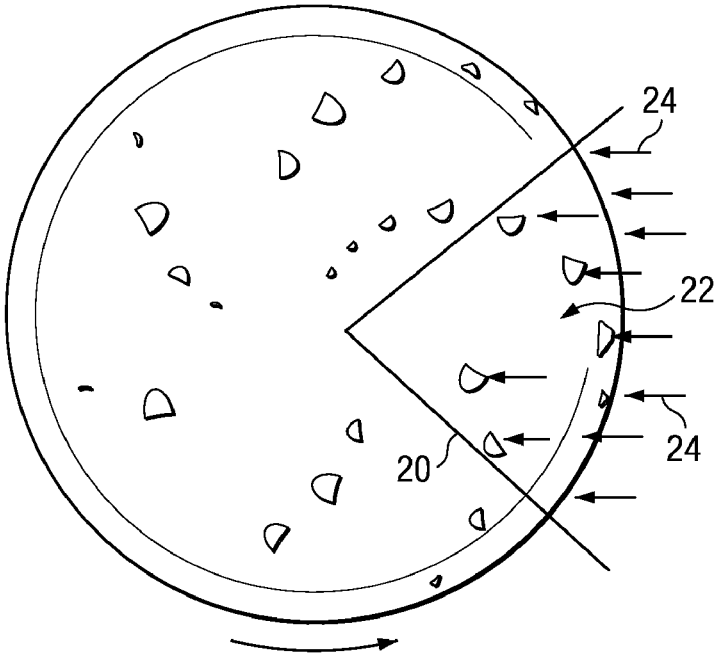
FIG. 5 shows a front view (face) of the bit.

Reference is now made to FIG. 5 showing a general front view (face) of the bit. The angle 20 illustrated in the drawing represents an angular section 22 of the bit that can vary from 0 to 360° (an approximately 90° angle is shown). This illustrates a splitting method useful in analyzing the force distribution over the bit face. The illustrated arrows 24 represent the loading on the bit face within the angular section. In the case of interrupted segments (as in the prior art), only a few areas of the bit face will be loaded which will result in an interrupted loading. In the case of straight segments, it is possible to define an angle (depending of the number of blades) which defines the analysis zone within which hardly any (and perhaps no) loading is applied.

There is a combination of the RPM for the bit and the number of blades (i.e., the angle) which results in a bit whirling. This bit whirling issue is highly detrimental to the segments which are of brittle material. Therefore, to avoid the premature destruction of the segment, in accordance with embodiments illustrated herein, the use of a continuous segment for each blade assures, in a "radial" manner, a uniform and not-interrupted loading all over the segment. Additionally, the use of spiral segments assures, in an "angular" manner, a uniform and not-interrupted loading all over the bit face. Consequently the borehole surface is properly covered.

Another advantage of the illustrated embodiments which use applied segments defining blade size, shape and configuration is the ability of using interchangeable nozzles which helps in hydraulics optimization. In a fixed nozzle implementation, two bits are built and set with fixed nozzles (named also ports but these ports can be threaded and a nozzle with a given inner diameter can be screwed therein). Conversely, a bit with interchangeable nozzles refers to changing the screwed nozzle portion of a bit with a first inner diameter by another nozzle with a second inner diameter. Such a concept is well understood by any bit designer skilled in the art.

The shape of the blade is variably (or adjustably) designed to suit the drillability of the rock formation of interest. For example, design variations are permitted with respect to both positive and negative back rake angle (angle $\alpha$ in FIGS. 6, 7A and 7B) and relief angle (angle $\beta$ in FIGS. 7A and B). The advantage of such design variation and flexibility for the segment is to keep the bit aggressive. These variations are applied not only from bit to bit (i.e., different bits have different designs), but also within one bit (i.e., different blades have different designs, or the design on a given blade varies along the length of the blade).

Impregnated bits are suited for use in drilling hard and abrasive formations. The segments are designed with respect to: back rake angle ($\alpha$) and relief angle ($\beta$). By selective choice of these variables in the bit design, one can design the bit with a capability to drill abrasive and sticky formations. Straight bladed bits are suited for use in drilling medium hard and abrasive to hard and abrasive formations. Spiraled bladed bits are suited for use in drilling soft and sticky and abrasive to hard and abrasive formations.

Figure 6:
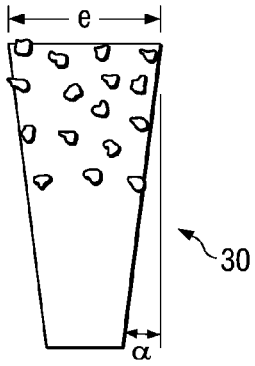
FIG. 6 illustrates back rake angle design variation for a blade in a bit embodiment.
Figure 7A:
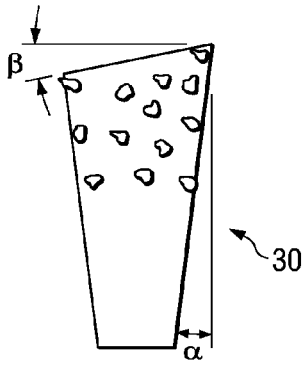
FIGS. 7A and 7B illustrate relief angle design variation for a blade in a bit embodiment.
Figure 7B:
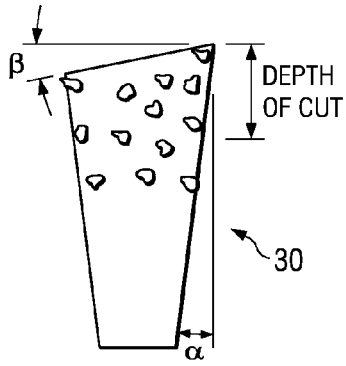

Reference is now made to FIGS. 6 and 7A. The first step is to design and build the segment 30 (which can be a straight segment 10 or spiral segment 12) and for that purpose it is mandatory to define the geometry of these segments. So, FIGS. 6 and 7A show the cross section of the segment 30 (at an arbitrary position along the segment length) as it should be before brazing or mounting the segment on the blade (previous FIGURES illustrate bits with straight segments and spiraled segments). The purpose is to illustrate the main shape parameters of the segment 30 (back rake angle and relief angle). It is for this reason the bit body itself is not illustrated in FIGS. 6 and 7A.

Figure 8A:
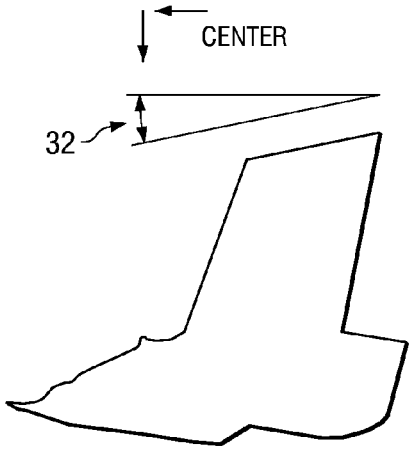
FIGS. 8A and 8B illustrate gradual adjustment of the negative relief angle from the inner to the outer part of the segment.
Figure 8B:
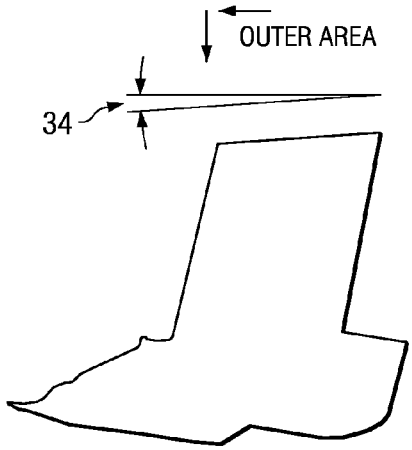

The value of the negative relief angles (β) can be set by the segment design to adjust gradually (i.e., change) as you move along the length of the segment from the inner part to the outer part of the segment on the bit (see, FIGS. 8A and 8B). FIGS. 8A and 8B illustrate how the design of the negative relief angles varies along the length of the blade. For example, in FIG. 8A a larger relief angle 32 is used in the design of the segment at a position along the length that is closer to the center of the blade, while in FIG. 8B a shallower relief angle 34 used in the design of the same segment at a position along the length that is towards the outer end of the blade (i.e., toward the gage). Although FIGS. 8A and 8B show two shapes/geometries for the segment a two different positions along the length of the segment, it will be understood that change in shape/geometry (for example, the angular change in relief angle) is continuous along the blade length.

It is recommended to use negative back rake angle on the front face of the segment but the angle on the back face of the segment can be either negative or positive (compare FIGS. 7A and 8A/8B where FIGS. 8A/8B show the use of a positive angle on the back face). The use of a negative angle on the front face will assure a better resistance of the segment by increasing the "shearing" section.

The gradual (continuous) adjustment of the value of the negative relief angles along the length of the segment 30 from the inner to the outer part of the segment on the bit is designed to fit the ratio: Depth of cut/Circumference at any radial point along the length of the segment.

It is understood that loading for a unit length of segment is given by the following equation:

$$P = f\left(\frac{\pi\mu a^2 \tan(\pi/4 - (\alpha+\beta)/2)}{l-\eta}\right)$$

Wherein: μ=Young Modulus and η=Poisson Ratio. The angles α and β are as defined in the drawings above and below as shown in FIG. 7C.

Figure 8C:
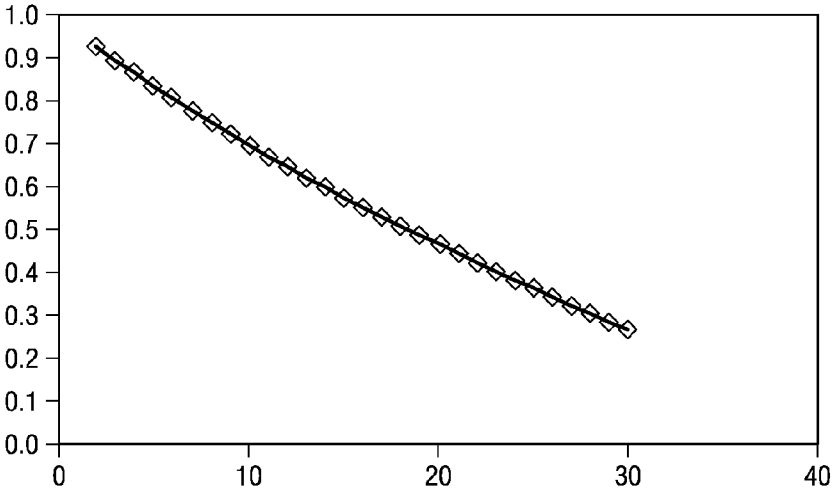
FIG. 8C graphically shows that loading decreases with the relief angle for a given depth of cut and bit design criteria.

FIG. 8C graphically shows that the loading decreases with the relief angle for a given depth of cut and bit design criteria. The use of high depth of cut in the inner area of the bit and low depth of cut in the outer area of the bit means that the loading will gradually decrease from the inner to the outer area of the bit. Therefore, the combination of these two phenomena that influence in opposite ways helps to get the same loading value at any point of the bit. It should be remembered: Depth of cut is related to the surface and the applied force on the segment (Depth of Cut=Applied Force/Contact Area) and the contact area is related to the geometry of the segment. The depth of cut is shown in an exemplary manner in FIG. 7B.

Configuring the geometry of the designed segments on each blade in the manner described above ensures—within the anticipated ROP range—that all the diamond grains across the segment in any direction will stress the rock at the same value, thus eliminating overload and balling at the tail of the segment (as pictorially shown with respect to a prior art segment in FIG. 10) and increasing the stress at the front face of the segment when the ROP drops. In addition, both the width and the back rake angle design of the impregnated segment can also be continuously adjusted for the tangential stress and required diamond volume per hole area.

Both the blade height and the back rake angle of the impregnated segment can also be continuously variably (or adjustably) designed according to the desired bit hydraulic. Bit hydraulic (cooling and cleaning) is driven by the geometry of the blades. High and thin blades will result in a higher open face volume (volume occupied by the fluid up to the bit junk level). Low open volume generates more turbulences and high hydraulic shear stress that can erode the bit body. Low open face volume also generates also high confining pressure between the bit body and the bottom hole which is responsible of the "chip hold down" phenomenon known to those skilled in the art (the chips are not removed from the bottom hole and no fresh rock is being cut). In such a scenario, the segment will grind debris of rock and the ROP falls.

The tangential stress and required diamond volume per hole area affects setting the blade height and back rake angle. The volume of diamond drives the bit life and is defined by the segment width, height and length (volume) and the diamond concentration (diamond content, grains size and sharpness). The loading decreases with the back rake angle (same behavior as the relief angle). The tangential stress has two components: Drag and Normal loading. The normal loading generates a frictional heat which is responsible of the segment wear. So as to extend the life of the bit, you can either reduce the loading by increasing the back rake angle or increasing the volume of diamond by increasing the segment height.

Figure 9:
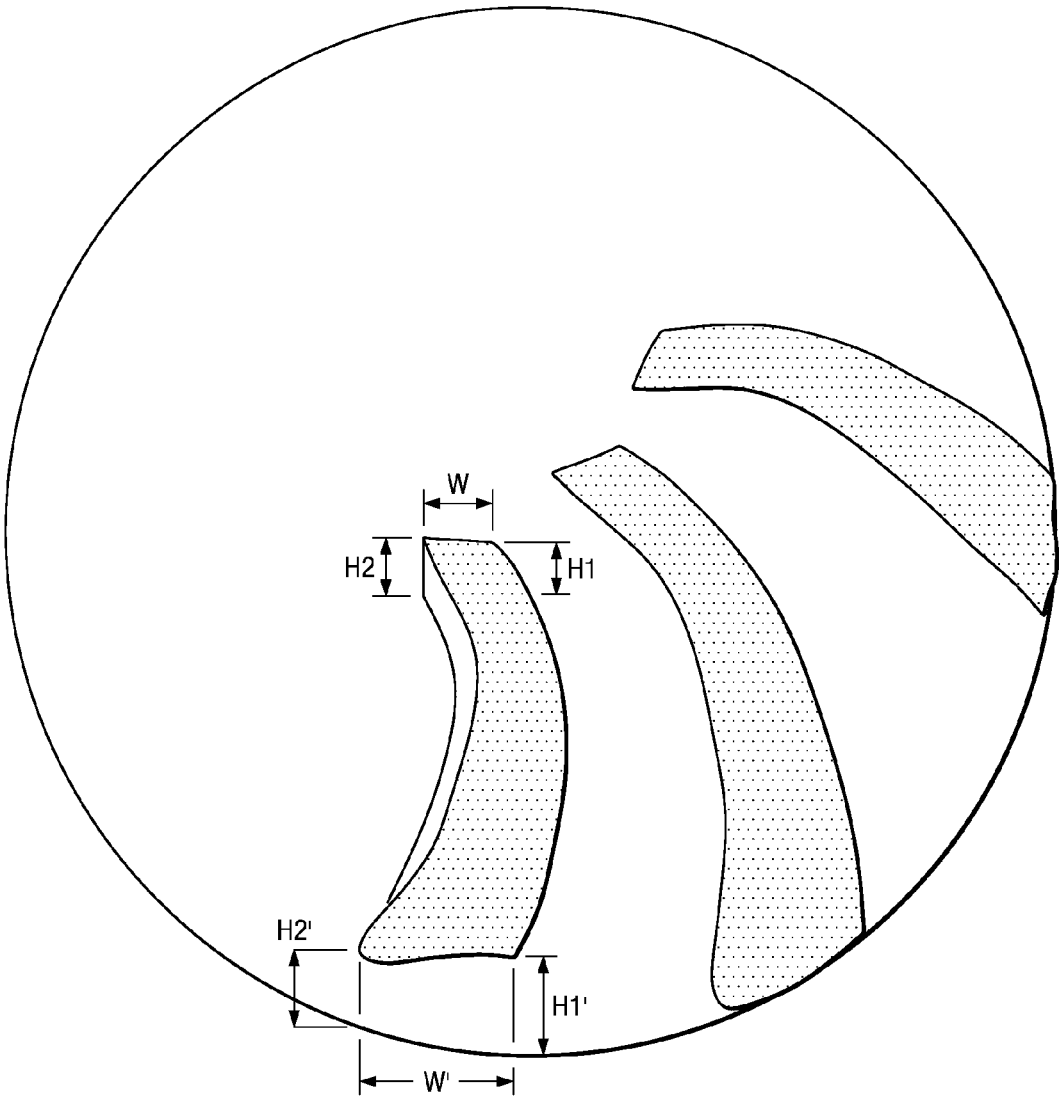
FIG. 9 illustrates a top (front face) view of a bit containing a plurality of exemplary spiral segments.

Reference is now made to FIG. 9 which illustrates a top (front face) view of a bit containing a plurality of exemplary spiral segments. The blade width (W) and height (H) are designed to variably (or adjustably) change in a continuous manner along the length of the segment in order to address the desired application. It will be noted that the width W of the segments gradually increases along the length of the segment. Additionally, there may be changes in height H along the length of the segment. Still further, the height on the leading edge of the segment (H1) and the height on the trailing edge of the segment (H2) need not be the same (compare to FIGS. 7A, 7B, 8A and 8B). Still further, the various heights H1 and H2 along the length of the segment may gradually change as is shown more clearly in the comparison of FIGS. 8A and 8B.

Although illustrated in FIG. 9 with respect to a spiral configuration design, similar comments concerning design adjustments for the blade width (W) and height (H) along the length of the segment are equally applicable to a straight blade configuration.

Figure 10:
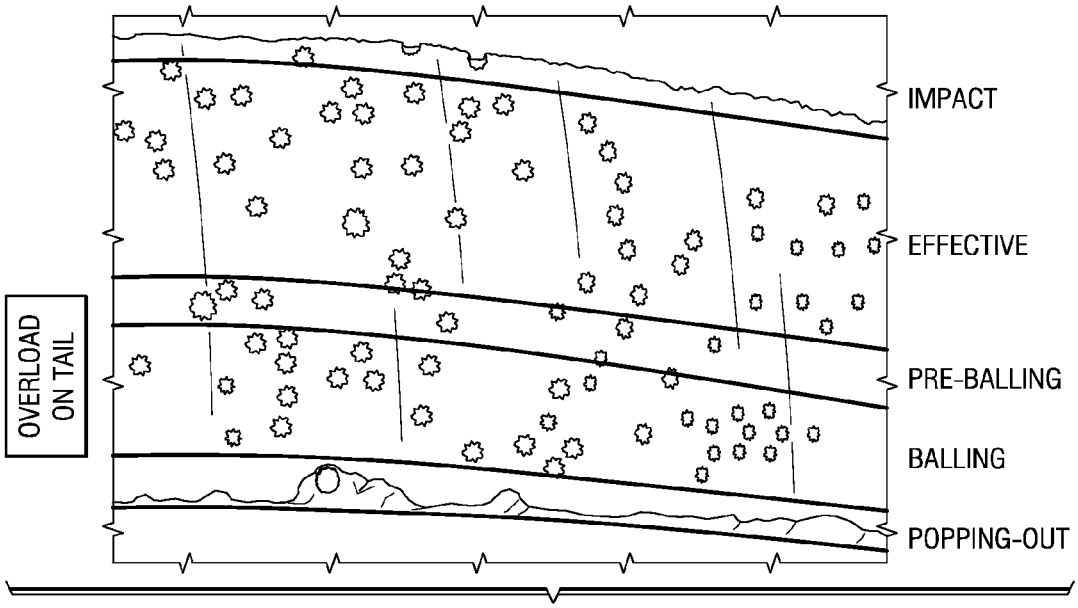
FIG. 10 (PRIOR ART)
FIG. 10 pictorially illustrates prior art concerns with overload and balling at the tail of the segment.

Reference is now made to FIG. 10. FIG. 10 pictorially shows a worn segment of a prior art design which exhibits various levels of degradation of a worn segment without a relief angle. The illustration shows, from the top to the bottom of the picture, various behavior at the segment and the rock interface. At the top of FIG. 10 there is shown the cutting edge which has been subjected to impact damage. The next zone is the effective zone. The remaining portions of the below the effective zone have been subjected to overloading. Debris are captured in this area which result in a pre-balling and a balling areas (zones). The free surface of the overloaded zone (trailing edge of the segment) can break as a result of high stress concentration (popping out of the diamond grains).

Figure 11:
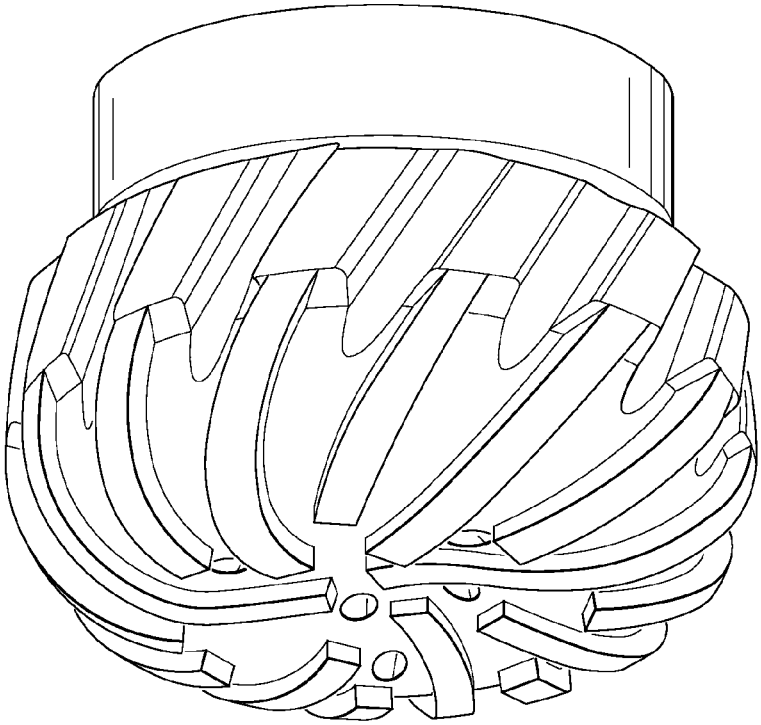
FIGS. 11-13 illustrate several views of the overall bit design and configuration in two embodiments (one spiral and one straight)
Figure 12:
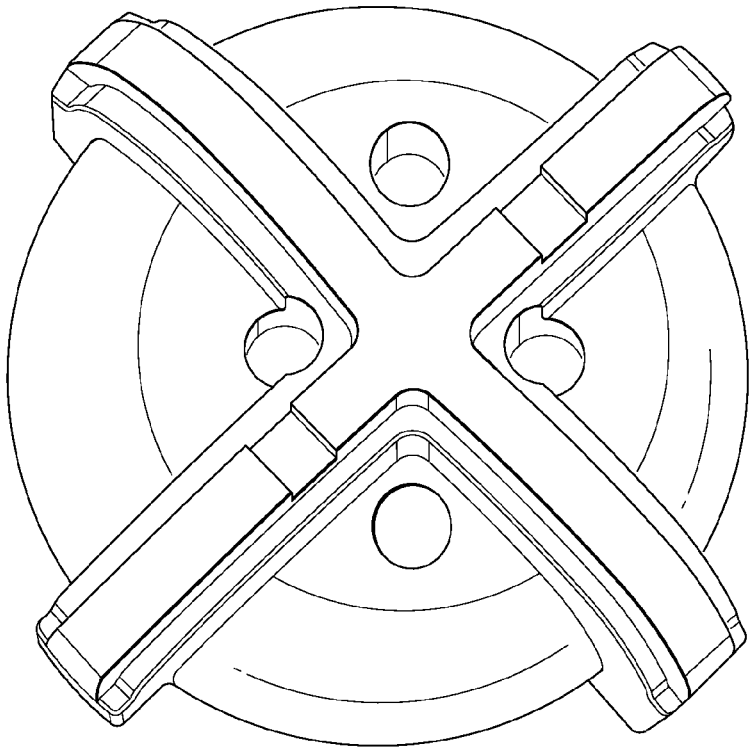
Figure 13:
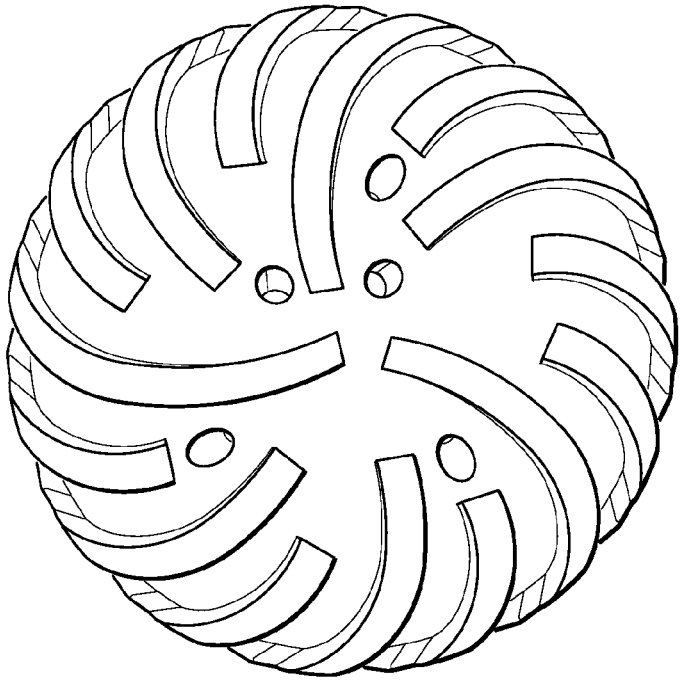

FIGS. 11-13 illustrate several views of the overall bit design and configuration in two embodiments (one spiral and one straight).

The continuous spiraled segment bit design of FIGS. 11 and 13 has been tested and proven capable of drilling in a variety of rock (limestone and sandstone) with acceptable ROP.

Figure 14:
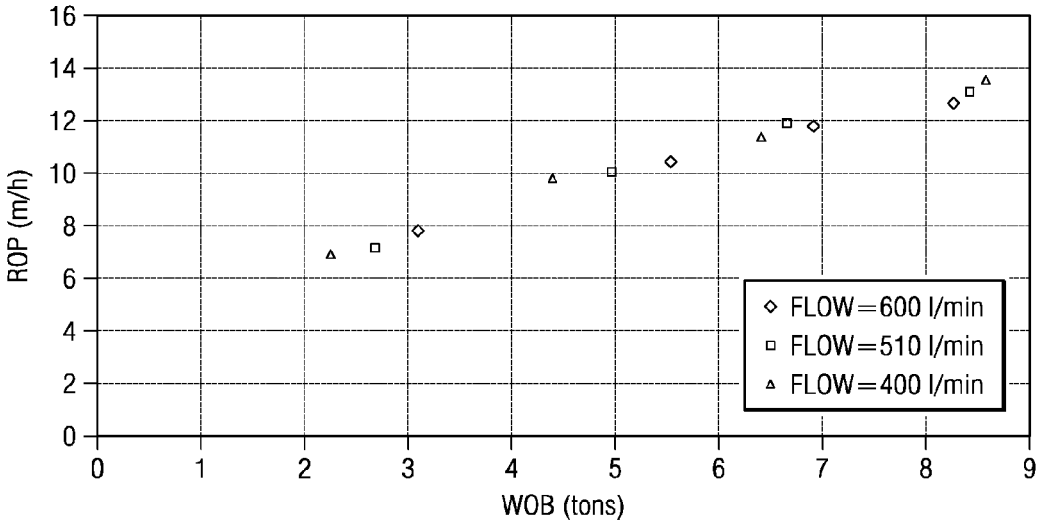
FIG. 14 graphically illustrates, for a continuous spiraled segment bit design, how rate of penetration (ROP) is related to weight on bit (WOB) for three different flow rates.

FIG. 14 illustrates, with respect to a test bit having a continuous spiraled segment bit design (like that shown in FIGS. 11 and 13), how rate of penetration (ROP) measured on the y-axis is related to weight on bit (WOB) for three different flow rates.

Figure 15:
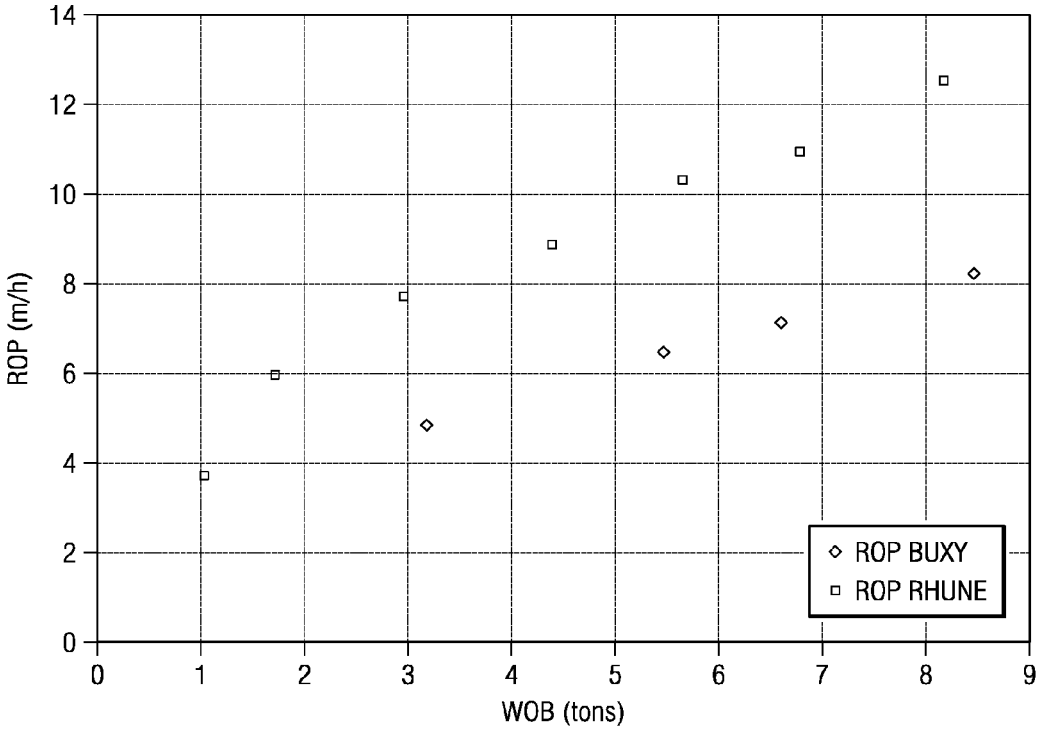
FIG. 15 illustrates, for a continuous spiraled segment bit design, how rate of penetration (ROP) is related to weight on bit (WOB) for two different types of rock.

FIG. 15 illustrates, with respect to a test bit having a continuous spiraled segment bit design (like that shown in FIGS. 11 and 13), how rate of penetration (ROP) measured on the y-axis is related to weight on bit (WOB) for two different types of rock.

Figure 16:
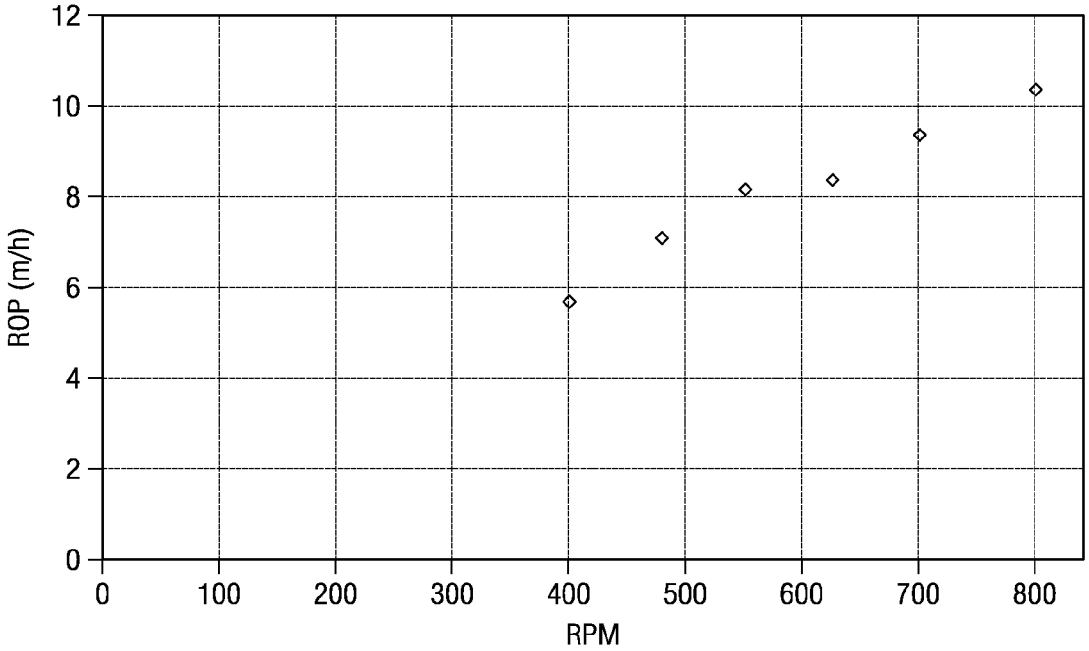
FIG. 16 illustrates, for a continuous spiraled segment bit design, how rate of penetration (ROP) is related to weight on bit (WOB).

FIG. 16 illustrates, with respect to a test bit having a continuous spiraled segment bit design (like that shown in FIGS. 11 and 13), how rate of penetration (ROP) measured on the y-axis is related to weight on bit (WOB).

Although preferred embodiments of the method and apparatus have been illustrated in the accompanying Drawings and described in the foregoing Detailed Description, it will be understood that the invention is not limited to the embodiments disclosed, but is capable of numerous rearrangements, modifications and substitutions without departing from the spirit of the invention as set forth and defined by the following claims.

What is claimed is:

1. A rotary drag bit comprising:

one or more straight blade locations;

a single straight continuous segment impregnated with diamond mounted per each straight blade location, the continuous segment defining a continuous cutting edge; and wherein a value of a back rake angle of the straight continuous segment continuously changes along the length of the continuous cutting edge from an inner portion of the segment to an outer portion of segment.

2. The bit of claim 1 wherein the straight continuous segment extends radially outwardly to the gage.

3. The bit of claim 1 wherein the straight continuous segment is mounted on one of a matrix body or a steel body bit at each straight blade location.

4. The bit of claim 3 wherein the straight continuous segment is attached to the bit body by one of brazing or furnacing.

5. The bit of claim 1 wherein each straight continuous segment has a top shape designed to suit a certain drillability of rock to be penetrated.

6. The bit of claim 5 wherein each straight continuous segment forms a straight blade including one of positive or negative back rake angles.

7. The bit of claim 5 wherein each straight continuous segment forms a straight blade including a relief angle in a top surface of the segment.

8. The bit of claim 7 wherein the relief angle is negative.

9. The bit of claim 8 where a value of the negative relief angle gradually changes along the length of the straight continuous segment from an inner portion of the segment to an outer portion of segment.

10. This bit of claim 9 wherein the value is proportional to a depth of cut divided by a circumference of the bit at any radial point along the length of the segment.

11. The bit of claim 1 wherein a width of the straight continuous segment gradually changes along the length of the straight continuous segment from an inner portion of the segment to an outer portion of segment.

12. The bit of claim 11 wherein the width increases from the inner portion to the outer portion.

13. A rotary drag bit comprising:

one or more straight blade locations;

a single straight continuous segment impregnated with diamond mounted per each straight blade location, the continuous segment defining a continuous cutting edge;

wherein a value of a back rake angle of the straight continuous segment continuously changes along the length of the continuous cutting edge from an inner portion of the segment to an outer portion of segment; and wherein a value of a negative relief angle formed by the straight continuous segment continuously changes along the length of the continuous cutting edge from an inner portion of the segment to an outer portion of segment.

14. A rotary drag bit comprising:

one or more straight blade locations;

a single straight continuous segment impregnated with diamond mounted per each straight blade location, the continuous segment defining a continuous cutting edge;

wherein a value of a back rake angle of the straight continuous segment continuously changes along the length of the continuous cutting edge from an inner portion of the segment to an outer portion of segment; and wherein a value of a diamond content in the straight continuous segment gradually changes along the length of the straight continuous segment from an inner portion of the segment to an outer portion of segment.

15. A rotary drag bit including one or more blades comprising only a single continuous segment per blade that is impregnated with diamond, each segment having a continuously varying back rake angle along a length of the segment from an inner portion of the segment to an outer portion of the segment.

16. The bit of claim 15 wherein a value of diamond content in the continuous segment gradually changes along the length of the continuous segment from an inner portion of the segment to an outer portion of segment.

17. The bit of claim 15 wherein the continuous segment is straight.

18. The bit of claim 15 wherein the continuous segment is spiral.

19. A rotary drag bit including one or more blades comprising only a single continuous segment per blade that is impregnated with diamond, each segment having a continuously varying relief angle along a length of the segment from an inner portion of the segment to an outer portion of the segment.

20. The bit of claim 19 wherein a value of diamond content in the continuous segment gradually changes along the length of the continuous segment from an inner portion of the segment to an outer portion of segment.

21. The bit of claim 19 wherein the continuous segment is straight.

22. The bit of claim 19 wherein the continuous segment is spiral.

* * * * *